United States Patent [19]

Glaser

[11] Patent Number: 5,075,936

[45] Date of Patent: Dec. 31, 1991

[54] CLASP FOR BRACELETS AND THE LIKE

[76] Inventor: Ellen A. Glaser, 1554 S. Sepulveda Blvd. #208, Los Angeles, Calif. 90025

[21] Appl. No.: 705,495

[22] Filed: May 24, 1991

[51] Int. Cl.[5] ..... A44B 11/25

[52] U.S. Cl. ..... 24/613; 24/615; 24/616

[58] Field of Search ..... 24/606, 607, 613, 615, 24/616, 618

[56] References Cited

U.S. PATENT DOCUMENTS

| | | | |
|---|---|---|---|
| 874,957 | 12/1907 | Godley | 24/615 |
| 921,846 | 5/1909 | Kerley | 24/616 |
| 926,602 | 6/1909 | Pollock | 24/616 |
| 2,986,792 | 6/1961 | Wyatt | 24/616 |
| 4,426,854 | 1/1984 | Geldwerth et al. | 24/616 |
| 4,532,682 | 8/1985 | Murad | 24/616 |
| 4,745,667 | 5/1988 | Conte | 24/615 |

FOREIGN PATENT DOCUMENTS

| | | | |
|---|---|---|---|
| 0294588 | 10/1916 | Fed. Rep. of Germany | 24/613 |
| 0376746 | 6/1923 | Fed. Rep. of Germany | 24/616 |
| 0144427 | 6/1920 | United Kingdom | 24/616 |

*Primary Examiner*—Victor N. Sakran

*Attorney, Agent, or Firm*—Gilbert Kivenson

[57] ABSTRACT

A clasp for bracelets and the like made up of two locking cylinders is described. The clasp is readily separated by compression, turning and then withdrawing one cylinder from the other.

3 Claims, 2 Drawing Sheets

CLASP FOR BRACELETS AND THE LIKE

BACKGROUND OF THE INVENTION

This invention relates to a jewelry clasp for use in bracelets, necklaces and the like. With the devices employed for this purpose in the prior art a common complaint has been the need for handling of very small locking mechanisms by persons with long finger nails. It is often necessary to obtain help from others when putting on jewelry and again when removing it. Existing devices are relatively complex and expensive to manufacture while simpler mechanisms are not secure enough with the result that a valuable piece of jewelry may become undone and be lost especially when the wearer puts on or takes off close-fitting outer wear.

The most commonly used device in the prior art has been a pair of loops one of which contains a spring loaded plunger spanning a narrow gap in the loop and an externally protruding activator pin. The other loop is uninterrupted. Each loop is attached to one free end of the bracelet or necklace. To fasten the jewelry requires the loops to be held close together at an approximate right angle. The plunger is retracted with a finger nail or bottom of a finger, the loops interlocked and the plunger released. With long finger nails it is difficult to retract the plunger. An early improvement in the art is represented by Houdy(French patent 547,608); this uses a principle more recently utilized in coaxial electrical connectors—i.e. one half of a cylindrically shaped clasp is hollow and provided with a J-shaped slot in its side and contains a spring. The other half of the clasp is smaller and contains a radially-oriented pin. The second half of the clasp is inserted into the first so that the pin enters the slot. Further insertion compresses the spring. The second half is then rotated so that the pin enters the curved portion of the J-shaped slot where it is retained under spring tension. Although this clasp is useable with long fingernails, it is difficult to unlock when made in small sizes.

A clasp using a somewhat different principle is taught by Murso (U.S. Pat. No. 4,532,682). One part of the clasp is provided with a collapsible tongue and a release trigger. The second half contains a slot which fits the trigger and an opening to accommodate the trigger. This construction provides good adherence of the two halves of the clasp when it is joined but is difficult to use with long nails. It is complex and relatively expensive to manufacture.

It is one objective of the present invention to permit opening and closing without the use of external release devices.

It is a second objective to achieve simplicity in manufacturing and low production cost.

DETAILED DESCRIPTION OF THE INVENTION

Figure 1:
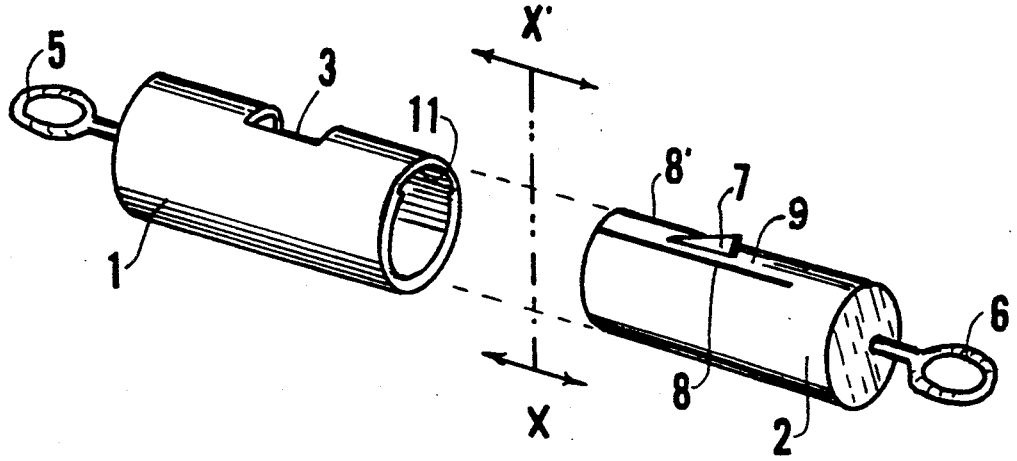
FIG. 1 is an isometric view of the clasp showing the male and female halves of a preferred embodiment of the invention.

In FIG. 1 the hollow cylinder 1 is open at one end and contains the slot 3 and the groove 11. Loop 5, set into the back wall of cylinder serves for coupling this half of the clasp to one end of a bracelet or necklace. A somewhat smaller, hollow cylinder 2 is slitted at 8 and 8' to form a spring section 9. A wedge shaped detent 7 is secured to the spring section by welding or other process. The effective spring constant of element 9 is controlled by the length of slits 8 and 8', by their separation and by the position of detent 7 along the length of 9. The loop 6 connects the second half of the clasp to the other side of the bracelet or necklace.

Figure 2:
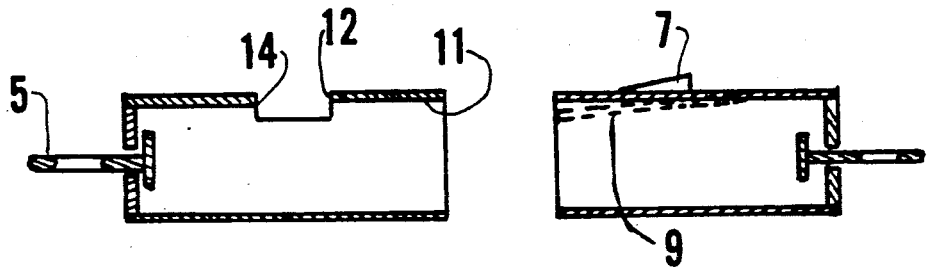
FIG. 2 is a cross section of the clasp taken along X—X' of FIG. 1

FIG. 2 is a cross section of the clasp taken along X—X' of FIG. 1 and shows the range of deflection of spring 9 when detent 7 is depressed. The groove 11 serves as an entry channel for the narrow part of the detent and makes for relatively easy depression of 7 against the spring 9 when cylinder 2 is first inserted into cylinder 1. After insertion cylinder 2 is moved axially until detent 7 is fully in slot 3 where it will emerge under the force of 9. Any force tending to pull the halves of the clasp apart will be resisted by the vertical wall of detent 7 bearing against wall 12 of slot 3. Any turning of the halves with respect to one another will similarly be resisted by the sides of the detent bearing against the side of slot 3.

Figure 3:
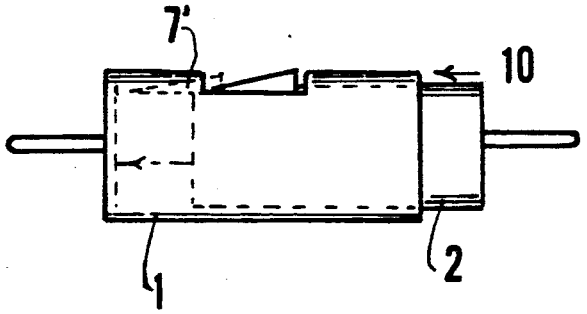
FIG. 3 is a side view of the clasp in its closed and locked position.

When it is desired to separate the clasp, cylinder 2 is pushed further into cylinder 1(direction 10 in FIG. 3). The slope angle of the detent is such as to permit it to slide beneath forward wall 14 of the slot, thus deactivating the restraining power of the detent. Rotating cylinder 2 with respect to cylinder 1 so as to misalign the detent with slot 3 now permits cylinder 2 to be withdrawn entirely from cylinder 1.

The materials of construction of the clasp can be metals(such as stainless steel or bronze) or plastic. Factors in the choice of materials are corrosion resistance, a good spring recovery rate and dimensional stability.

Figure 4:
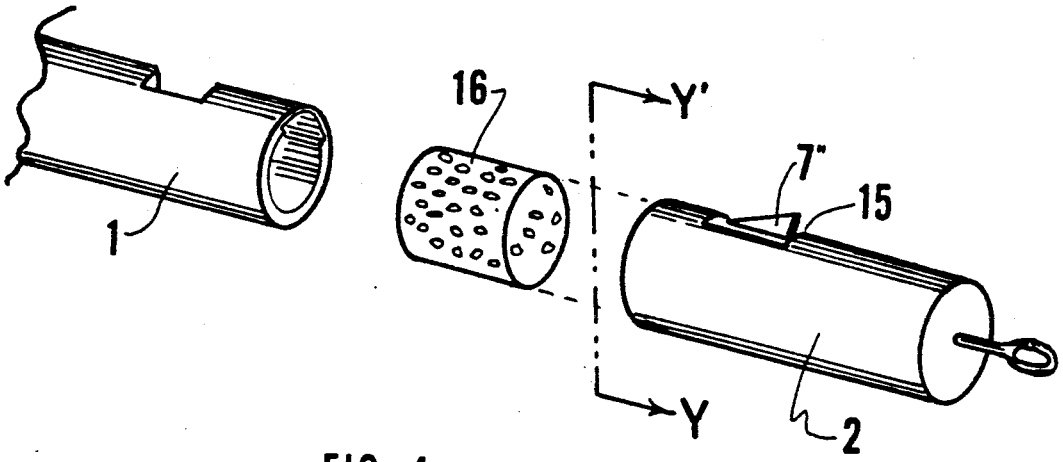
FIG. 4 is an isometric and exploded view of a second embodiment of the invention.
Figure 5:
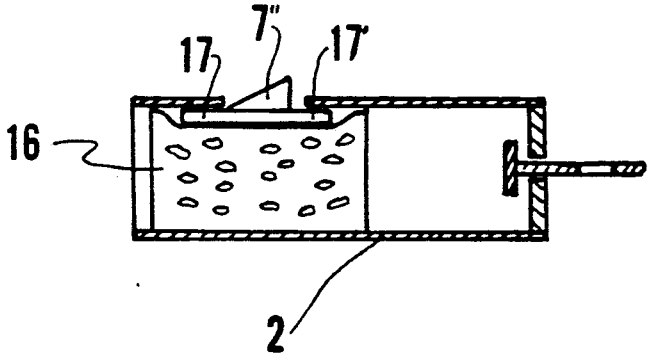
FIG. 5 is a cross section of the second embodiment taken along Y—Y' of FIG. 4

In FIGS. 4 and 5 are shown a second embodiment of the invention. In this embodiment no slitting of cylinder 2 is employed. A rectangular slot 15 is cut in the side of cylinder 2 as shown. A detent 7" is provided with extensions 17 and 17' to engage an elastomeric cylinder 16 which is cemented inside the cylinder 2. Cylinder 16 serves as a

What is claimed is:

1. A clasp for the convenient joining and separating of the ends of certain jewelry such as bracelets and necklaces and the like comprising:

a. a first hollow cylinder open at one end, provided with a rectangular opening partly along one side, a groove along the inside surface of the cylinder extending axially from the open end to said rectangular opening and means fixed to the closed end for attaching the cylinder to one end of the jewelry;

b. a second, hollow and smaller cylinder open at one end which can be slid into the first cylinder and is provided with a vertically oriented, wedge shaped detent structure mounted on an elastomeric material for engaging and locking into said rectangular opening in the first cylinder and means fixed to the closed end of the second cylinder for joining to the second end of said jewelry;

whereby inserting the open end of the second cylinder into the open end of the first in a radial alignment which permits the elastomer-loaded detent to enter said groove, depresses the detent, compresses the elastomer and with continued, sliding insertion causes the detent to expand into the rectangular opening in the first cylinder thus locking the two cylinders together against being pulled apart and against being rotated with respect to one another.

2. A clasp as described in claim 1 in which the back edge and sides of the wedge shaped detent are vertical to prevent back or rotary motion of the second cylinder with respect to the first when the two cylinders are engaged, while the wedge shape of the detent will allow further forward motion when desired.

3. A clasp as described in claim 1 in which the first cylinder can be separated from the second when they are in the locked position by pushing the cylinders together causing the detent to be depressed, rotating the first cylinder with respect to the second and then pulling them apart.

* * * * *